United States Patent [19]

Adams

[11] 4,153,085

[45] May 8, 1979

[54] FUEL DISPENSING NOZZLE

[75] Inventor: Leon Adams, Lansing, Mich.

[73] Assignee: General Motors Corporation, Detroit, Mich.

[21] Appl. No.: 906,962

[22] Filed: May 18, 1978

[51] Int. Cl.[2] ..... B65B 3/04; B67D 5/37

[52] U.S. Cl. ..... 141/311 R; 141/392

[58] Field of Search ..... 141/1, 198, 206–229, 141/201, 302, 311 R, 346, 347, 351, 352, 360, 362, 392

[56] References Cited

U.S. PATENT DOCUMENTS 3,710,831 1/1973 Riegel ..... 141/207

3,994,323 11/1976 Takahata et al. ..... 141/392 X

*Primary Examiner*—Richard E. Aegerter
*Assistant Examiner*—Frederick R. Schmidt
*Attorney, Agent, or Firm*—Donald F. Scherer

[57] ABSTRACT

A dispensing nozzle for delivering fuel to selective fuel tanks has a control rod which must be displaced longitudinally by a restrictor plate in the fill tube of the fuel tank before the manual lever of the dispensing nozzle is effective to open the flow controlling valve of the dispensing nozzle. Thus, the introduction of one grade of fuel into a tank not having a restrictor plate and requiring a different grade of fuel is prevented.

1 Claim, 3 Drawing Figures

FUEL DISPENSING NOZZLE

This invention relates to fuel dispensing nozzles and more particularly to such nozzles wherein it is desirable to dispense the fuel only into selective fuel tanks.

Prior art devices such as those shown in U.S. Pat. Nos. 2,547,690 to Chadil et al, issued Apr. 3, 1951; U.S. Pat. No. 3,259,154 to Scherer, issued July 5, 1966 and U.S. Pat. No. 2,818,889 to Krause, issued Jan. 7, 1958, provide for both automatic shut-off on fuel tank filling and for preventing fuel dispersement until the nozzle is inserted into a fuel tank filler tube. However, these nozzles do not prevent the dispensing of one grade of fuel into a tank requiring a separate grade of fuel, since the devices, which determine when the nozzle is disposed in a tank, cannot differentiate between tanks requiring various grades of fuel.

The present invention will prevent the dispensing of one grade of fuel, such as unleaded gasoline, into a fuel tank requiring a different grade of fuel, such as diesel fuel. As is well known in present fuel tanks, those requiring unleaded fuel have a restrictor plate to limit the introduction of the dispensing nozzle which has a diameter larger than the restrictor plate. To prevent the insertion or dispensing of unleaded fuel into a diesel fuel tank, a control rod is added to the unleaded fuel dispensing nozzle which must engage the restrictor plate, in the unleaded fuel tank, prior to the operator valve being conditioned for operation to dispense fuel. Thus, unleaded fuel cannot be dispensed into a tank requiring diesel fuel. This fuel nozzle is particularly useful at vehicle assembly locations where spark ignition engine and diesel engine powered vehicles are produced simultaneously.

It is an object of this invention to provide an improved dispensing nozzle which prevents introduction of undesirable fuel into a fuel tank.

It is another object of this invention to provide an improved dispensing nozzle having a control rod which must be engaged by a restrictor plate in the fuel tank and moved longitudinally before the dispensing nozzle valve is conditioned to be operative.

These and other objects and advantages of the present invention will be more apparent from the following description and drawing in which.

Figures 1, 2, 3:
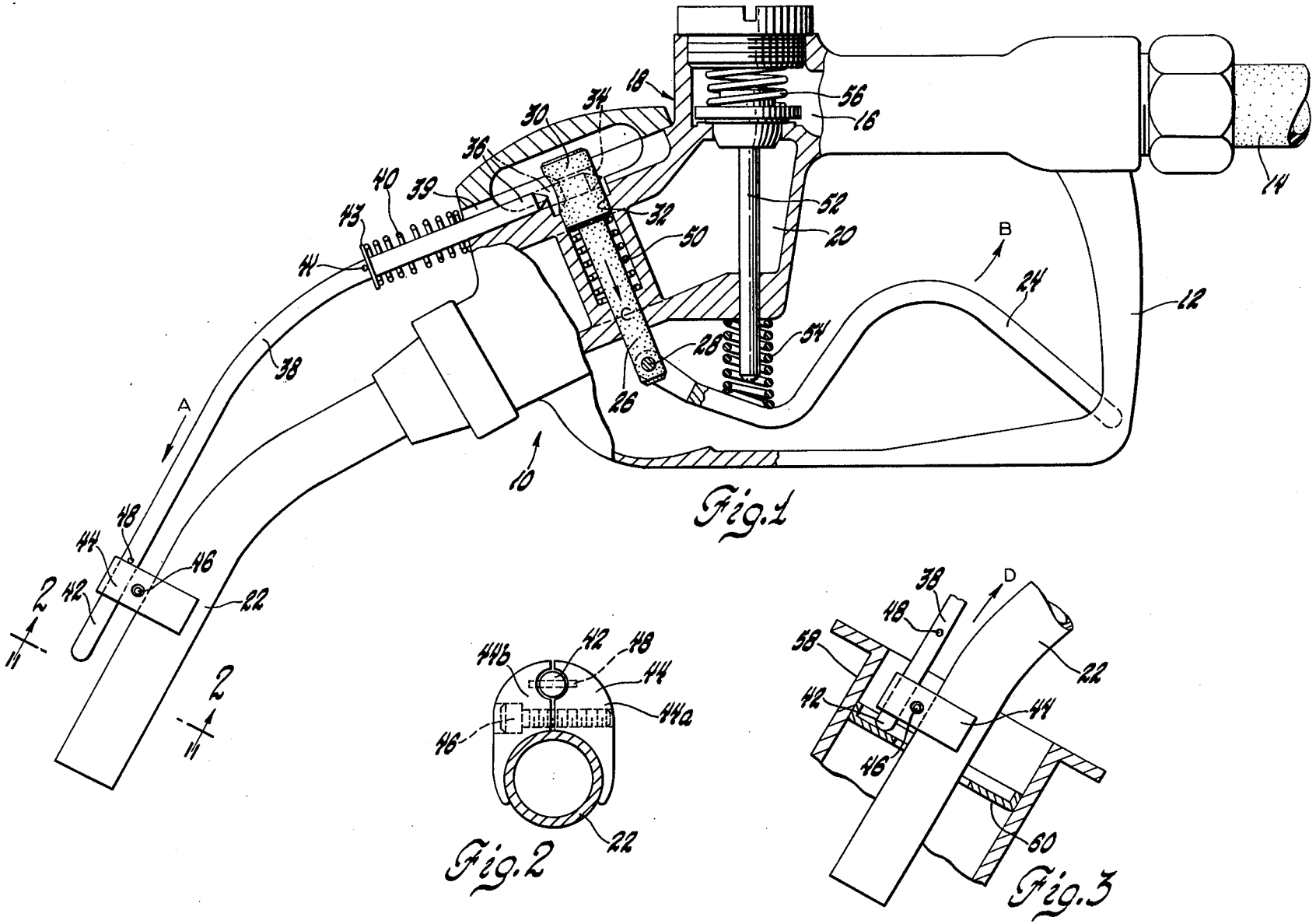
FIG. 1 is a side elevational view, partly in section, of the dispensing nozzle.
FIG. 2 is a view taken along line 2—2 of FIG. 1.
FIG. 3 is a view of a portion of the nozzle disposed in a fill tube.

Referring to the drawing, there is shown a fuel dispensing nozzle, generally designated 10, having a handle portion 12 to which is secured a conventional fuel delivery hose 14. The handle portion 12 has a fuel passage 16 which is normally closed by a valve assembly 18, and a delivery passage 20, downstream of valve 18, which directs fuel to a dispensing tube 22 adapted to be inserted into the fuel tank. An operator lever 24, disposed within the handle 12, is pivotally connected to a plunger 26 for rotation about a pin 28. The plunger 26 has an enlarged end 30 which is slidably disposed in a bore 32 formed in the handle 12. The enlarged end 30 has a transverse bore 34 formed therein which cooperates with an end 36, of a control rod 38, which is slidably disposed in an opening 39 in the handle 12 and which rod 38 is springloaded by a coil spring 40 to maintain the end 36 out of engagement with the opening 34. The coil spring 40 reacts against the handle 12 and, through a pin 41 and washer 43, the rod 38, to urge the rod in the direction of arrow A. The other end 42, of rod 38, is slidably disposed in a split clamp member 44 which is clamped on the tube 22 by having the portions **44*a* and 44*b* of the member 44 drawn together by a threaded fastener 46 while leaving sufficient clearance around rod 38** for freedom of longitudinal movement.

A pin 48, secured in the control rod 38, limits the movement of control rod 38 in the direction of arrow A. The plunger 26 is urged to the position shown by a coil spring 50 disposed in the bore 32 while the lever 24 is urged out of abutment with a stem 52 which is part of valve 18, by a spring 54. The valve 18 is a conventional valve which is normally used with these types of fuel dispensing nozzles and is urged to the closed position by a coil spring 56. The force in spring 54 is sufficient such that when control rod 38 is not engaged in opening 34, and the lever 24 is moved in the direction of arrow B, the plunger 26 will move in the direction of arrow C such that the lever 24 will not engage the stem 52 of valve 18. Thus, the valve 18 will not be opened and fuel will not be communicated from passage 16 to passage 20.

When the fuel nozzle is inserted in a fuel tank filler tube, such as that shown at 58, which has a restrictor plate 60 disposed therein, the end 42 of control rod 38 will abut the restrictor plate 60 forcing the control rod 38 in the direction of arrow D against the force in spring 40, such that end 36 will enter the opening 34 thus permitting the lever 24 to pivot about pin 28 and engage the stem 52 thereby opening valve 18. Fuel will then be introduced from passage 16 to passage 20 and, through dispensing tube 22, into the fuel tank, not shown. If the restrictor plate 60 is not present, the control rod 38 will not be moved longitudinally in the direction of arrow D such that the lever 24 cannot operate the valve 18 thus preventing the dispensing of fuel into a fuel tank not having a restrictor plate.

Obviously, many modifications and variations are possible in light of the above teaching. It is, therefore, to be understood that within the scope of the appended claims, the invention may be practiced otherwise than as specifically described.

The embodiments of the invention in which an exclusive property or privilege is claimed are defined as follows:

1. A fuel dispensing nozzle for dispensing fuel into a fuel tank having a fill tube and a restrictor plate secured in said fill tube and having an aperture slightly larger than said nozzle, said dispensing nozzle comprising; a handle, a lever and a valve mechanism for controlling fuel dispensing; a fuel delivery tube extending from said handle; a fulcrum slidably mounted in said handle and pivotally connecting said lever to said handle and being movable by said lever between an operative position wherein said lever will operate said valve and an inoperative position wherein said lever will not operate said valve; a control aperture in said fulcrum; and a fulcrum control mechanism comprising a support secured to said fuel delivery tube; a control rod having one end slidably mounted in said support and the other end slidably mounted in said handle adjacent the control aperture in said fulcrum, and spring means urging said rod toward said support and removed from said control aperture so that said fulcrum is free to move to said inoperative position, said control rod being movable by abutment with said restrictor plate when said fuel delivery tube is inserted through said aperture, said movement being sufficient to engage said control rod in said control aperture so that said fulcrum will be held in said operative position whereby said valve mechanism can be operated by movement of said lever.

* * * * *